US010837307B2

(12) United States Patent
Perez

(10) Patent No.: US 10,837,307 B2
(45) Date of Patent: Nov. 17, 2020

(54) SYSTEM OF VARIABLE STATOR VANES FOR A TURBINE ENGINE

(71) Applicant: Safran Aero Boosters SA, Herstal (BE)

(72) Inventor: Rafael Perez, Boncelles (BE)

(73) Assignee: SAFRAN AERO BOOSTERS SA, Herstal (BE)

( * ) Notice: Subject to any disclaimer, the term of this patent is extended or adjusted under 35 U.S.C. 154(b) by 91 days.

(21) Appl. No.: 16/034,451

(22) Filed: Jul. 13, 2018

(65) Prior Publication Data

US 2019/0048738 A1 Feb. 14, 2019

(30) Foreign Application Priority Data

Aug. 14, 2017 (BE) ..... 2017/5557

(51) Int. Cl.
*F01D 17/16* (2006.01)
*F04D 29/56* (2006.01)
*F04D 29/54* (2006.01)

(52) U.S. Cl.
CPC ..... *F01D 17/162* (2013.01); *F04D 29/544* (2013.01); *F04D 29/563* (2013.01); *F05D 2240/12* (2013.01); *F05D 2260/40* (2013.01); *F05D 2260/57* (2013.01)

(58) Field of Classification Search
CPC ..... F01D 9/041; F01D 17/14; F01D 17/16; F01D 17/162; F05D 2240/128; F05D 2260/50; F04D 29/563
See application file for complete search history.

(56) References Cited

U.S. PATENT DOCUMENTS 2,862,654 A * 12/1958 Gardiner ..... F01D 17/162 415/161
4,214,852 A * 7/1980 Tuley ..... F01D 5/18 415/115
4,867,635 A * 9/1989 Tubbs ..... F01D 17/162 415/159
4,978,280 A 12/1990 Tubbs
(Continued)

FOREIGN PATENT DOCUMENTS

EP 0532907 A1 3/1993
EP 1331403 A1 7/2003
(Continued)

OTHER PUBLICATIONS

European Search Report from corresponding Belgium Application No. BE 201705557, dated Apr. 8, 2018.

*Primary Examiner* — Courtney D Heinle
*Assistant Examiner* — Andrew Thanh Bui
(74) *Attorney, Agent, or Firm* — Sandberg Phoenix & von Gontard, P.C.

(57) ABSTRACT

The invention relates to a system of vanes with adjustable orientation, also called a system of variable stator vanes, for a low-pressure compressor of an axial turbine engine. The system comprises vanes, each having a vane extending radially in a flow of the turbine engine and a spindle having a cylindrical portion connected to a telescopic actuating lever. The cylindrical portion comprises radially extending slot, and the actuating lever comprises a pivot joint housed in the slot, that is configured to communicate a rotary movement to the vane about its spindle. The invention also proposes a compressor and a turbine engine.

5 Claims, 4 Drawing Sheets

(56) References Cited

U.S. PATENT DOCUMENTS

| | | | | | |
|---|---|---|---|---|---|
| 5,492,446 | A * | 2/1996 | Hawkins | F01D 17/162 | 411/116 |
| 5,993,152 | A * | 11/1999 | Schilling | F01D 17/162 | 415/155 |
| 7,223,066 | B2 * | 5/2007 | Rockley | F01D 17/162 | 415/160 |
| 8,087,883 | B2 * | 1/2012 | Bouru | F04D 29/563 | 415/160 |
| 10,590,957 | B2 * | 3/2020 | Theux | F04D 29/542 | |
| 2013/0272852 | A1 * | 10/2013 | Allford | F01D 9/00 | 415/148 |

FOREIGN PATENT DOCUMENTS

| | | | | |
|---|---|---|---|---|
| EP | 3533974 | A1 * | 9/2019 | F04D 29/563 |
| FR | 2882577 | A1 | 9/2006 | |

* cited by examiner

SYSTEM OF VARIABLE STATOR VANES FOR A TURBINE ENGINE

CROSS-REFERENCE TO RELATED APPLICATIONS

This application claims the benefit, under 35 U.S.C. § 119, of BE 2017/5557 filed on Aug. 14, 2017, the disclosure of which is incorporated herein by reference in its entirety.

FIELD

The invention relates to a turbine engine blade whose orientation is controlled by a telescopic actuating lever. The invention also relates to an axial turbine engine, notably a turbojet of an airplane or a turboprop of an aircraft.

BACKGROUND

A variable-geometry compressor has a narrow surge margin. This margin may be extended, for various operating conditions, by providing a system of variable stator vanes, or adjustable blades. This provides greater safety and enables the compressor to operate in the optimal way. Such compressors, in the context of an axial turbine engine, commonly comprise radially orientated spindles which allow adjustable vanes to pivot about their own axes.

Actuating levers connected to the spindles are still required in order to communicate the movements for a change of orientation to each vane. If these levers are connected to an axially fixed synchronizing ring, the levers must be geometrically adaptable. In fact, such levers must also increase in length because the spindles are also fixed axially.

U.S. Pat. No. 4,978,280 A discloses a system of variable stator vanes for an aircraft turbojet. In this system, the vanes comprise spindles guiding the pivoting movements of the vanes, thus allowing controlled changes in pitch. The spindles are fitted with flanges in which are fixed actuating levers, which are themselves connected to a synchronizing ring. These levers are telescopic so that they can increase in length during the operation of the synchronizing ring. However, the reliability of this system is limited. Furthermore, the radial dimension of this assembly is large.

SUMMARY

The object of the invention is to resolve at least one of the problems posed by the prior art. More precisely, the object of the invention is to improve the radial compactness of a system of variable stator vanes. The invention also has the object of proposing a solution that is simple, strong, lightweight, economical, reliable, simple to produce, convenient to maintain, easy to inspect, and offers improved efficiency.

In various embodiments, the present disclosure provides a system of vanes with adjustable orientation for an axial compressor of a turbine engine, the system comprises: a telescopic actuating lever; a vane with a vane body designed to extend radially in a flow of the turbine engine, and a spindle comprising a cylindrical portion; wherein the cylindrical portion comprises a radially extending slot; and the telescopic actuating lever comprises a pivot joint housed in the slot that is configured to communicate a rotational movement to the vane about its spindle.

According to various advantageous embodiments of the invention, the system can comprise one or more of the following characteristics, considered in isolation or in any technically feasible combinations:

- The slot comprises inner surfaces in contact with the pivot joint of the lever.
- The slot passes diametrically through the cylindrical portion.
- The telescopic actuating lever comprises a portion of reduced thickness, through which the pivot joint passes.
- The portion of reduced thickness is positioned in the slot.
- The telescopic actuating lever comprises a socket and a slider sliding inside the socket, the pivot joint being fixed to the socket.
- The socket comprises a cavity in which the slider slides, the cavity being at a distance from the slot and the pivot joint.
- The cavity is axially at a distance from the cylindrical portion.
- The vane has a mean thickness which is greater than the width of the slot.
- The spindle comprises a radial end, the pivot joint being positioned radially between the vane and the radial end.
- The pivot joint is inscribed in the perimeter of the cylindrical portion.
- The pivot joint has a pivot axis, the spindle has an axis of rotation cutting the pivot axis at an intersection point, the axes being optionally perpendicular.
- The spindle has a constant diameter over most of its height, and/or at the radial position of the slot.
- The telescopic actuating lever comprises opposed lateral surfaces which are in contact with the slot.
- The telescopic actuating lever is integrated radially into the height of the spindle, and into the height of the slot if necessary.
- The system comprises a synchronizing ring which is fixed axially relative to the spindle.
- The system is configured so that the vane can pivot about its own axis through an angle of 30° or more.
- The system is configured so that the vane can pivot about its own axis through an angle which is greater than or equal to: 10° or 20° or 35°.
- The slot has a radial height, a length, and a width which is smaller than the length.
- The width of the pivot joint and/or of the slot is/are measured along the pivot axis of the pivot joint.
- The point of intersection is positioned in the spindle, notably in the cylindrical portion.
- The slot is in the radial extension of the vane.
- The width of the pivot joint is smaller than the diameter of the spindle.
- The system comprises a casing with an opening through which the spindle passes.
- The slot comprises, or is possibly composed of, three open sides and one closed side.
- The width of the slot is adjusted to the width of the lever, so that the lever can transmit a torque to the spindle.
- The vane and the cylindrical portion form a one-piece assembly.

In various embodiments, another object of the invention is a compressor, the compressor comprising a system of vanes with adjustable orientation, remarkable in that the system is in accordance with the invention, and the compressor is in various instances a low-pressure compressor.

According to various advantageous embodiments of the invention, the vanes and levers within the same row are identical.

According to various advantageous embodiments of the invention, the system comprises one or more annular rows of vanes with adjustable orientation.

In various embodiments, a further object of the invention is a turbine engine, notably an aircraft turbojet, comprising a system of vanes with adjustable orientation, remarkable in that the system is in accordance with the invention, and the turbine engine in various instances comprises a compressor according to the invention.

As a general rule, the advantageous embodiments of each object of the invention are equally applicable to the other objects of the invention. Each object of the invention can be combined with the other objects, and the objects of the invention can also be combined with the embodiments of the description, which can also be combined with one another in any technically feasible combinations, unless there is an express statement to the contrary.

The invention enables the lever to be housed in the spindle, but also enables the fastening means between the lever and the spindle to be placed in the area occupied by the spindle. Thus, the space around the spindles and the levers remains free and does not border on any unoccupied spaces. The space around the support casing is used in an optimal way.

The integration of the pivot joint into the radial height of the spindle enables the lever to be lowered. The lever is moved radially closer to the support casing. It becomes easier to integrate a de-icing system, notably by using hot fluid supply lines, at the position of the levers.

The torque transmission can be carried out at the same time by means of the rod.

DRAWINGS

DETAILED DESCRIPTION

In the following description, the terms "inner" and "outer" refer to positions relative to the axis of rotation of an axial turbine engine. The axial direction corresponds to the direction along the axis of rotation of the turbine engine. The radial direction is perpendicular to the axis of rotation. The terms "upstream" and "downstream" refer to the main direction of flow in the turbine engine.

Figure 1:
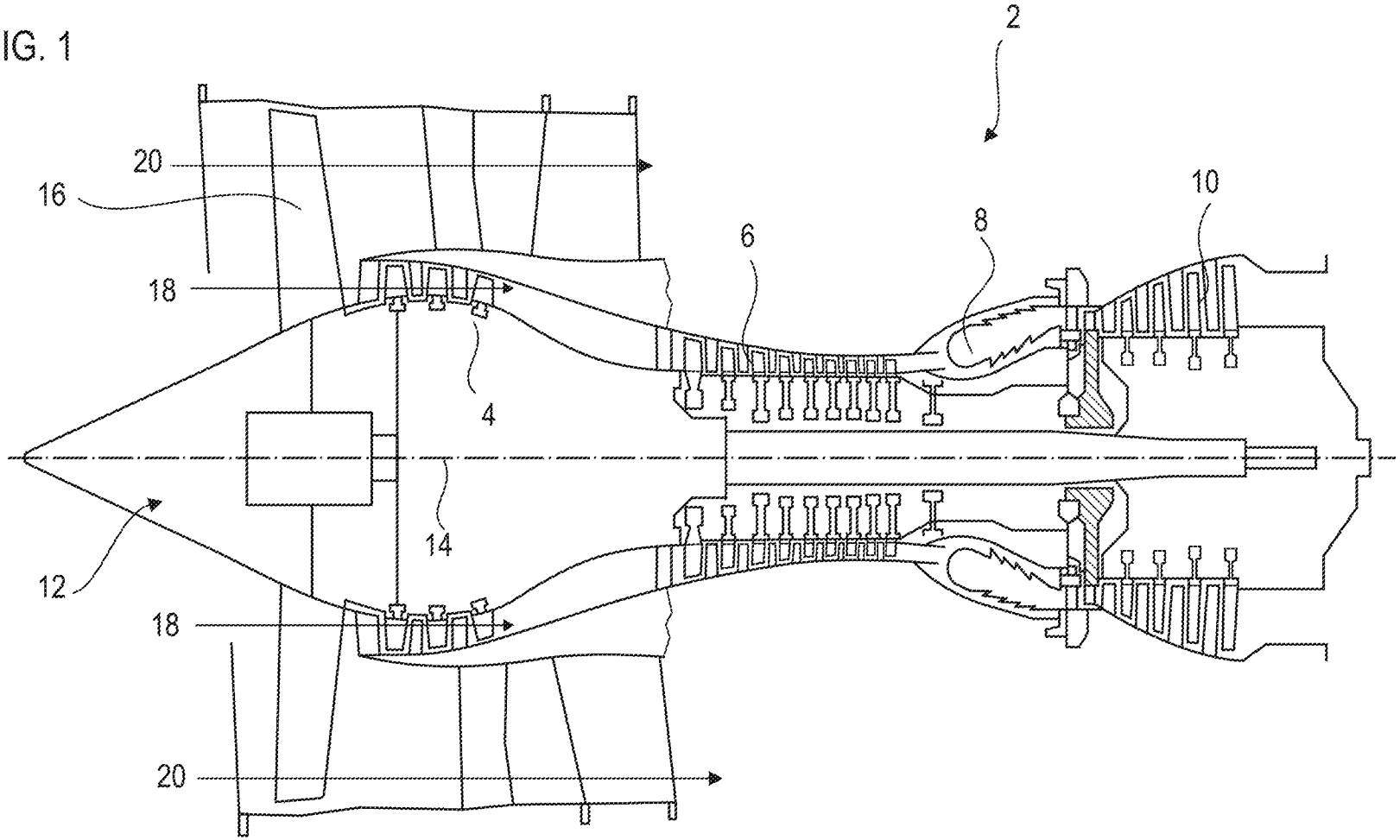
FIG. 1 shows an axial turbine engine according to various embodiments of the invention.

FIG. 1 shows an axial turbine engine in a simplified manner. In this particular case, the engine is a double-flow turbojet. The turbojet 2 comprises a first compression stage called the low-pressure compressor 4, a second compression stage called the high-pressure compressor 6, a combustion chamber 8 and one or more turbine stages 10. In operation, the mechanical power of the turbine 10 transmitted via the central shaft to the rotor 12 causes the two compressors 4 and 6 to move. These compressors have a plurality of rows of rotor vanes associated with rows of stator vanes. The rotation of the rotor about its axis of rotation 14 can thus generate an air flow and progressively compress this air flow up to the intake of the combustion chamber 8.

An intake fan, commonly referred to as a fan or blower 16, is coupled to the rotor 12 and generates an air flow divided into a primary flow 18, which passes through the aforementioned different stages of the turbine engine, and a secondary flow 20, which passes through an annular duct (partially shown) along the machine and then joins the primary flow leaving the turbine.

Speed reduction means such as an epicyclic reduction gear can reduce the rotation speed of the blower and/or of the low-pressure compressor relative to the associated turbine. The secondary flow can be accelerated so as to generate a thrust reaction required for the flight of an aircraft. The primary flow 18 and the secondary flow 20 are coaxial annular flows, one taking place inside the other.

Figure 2:
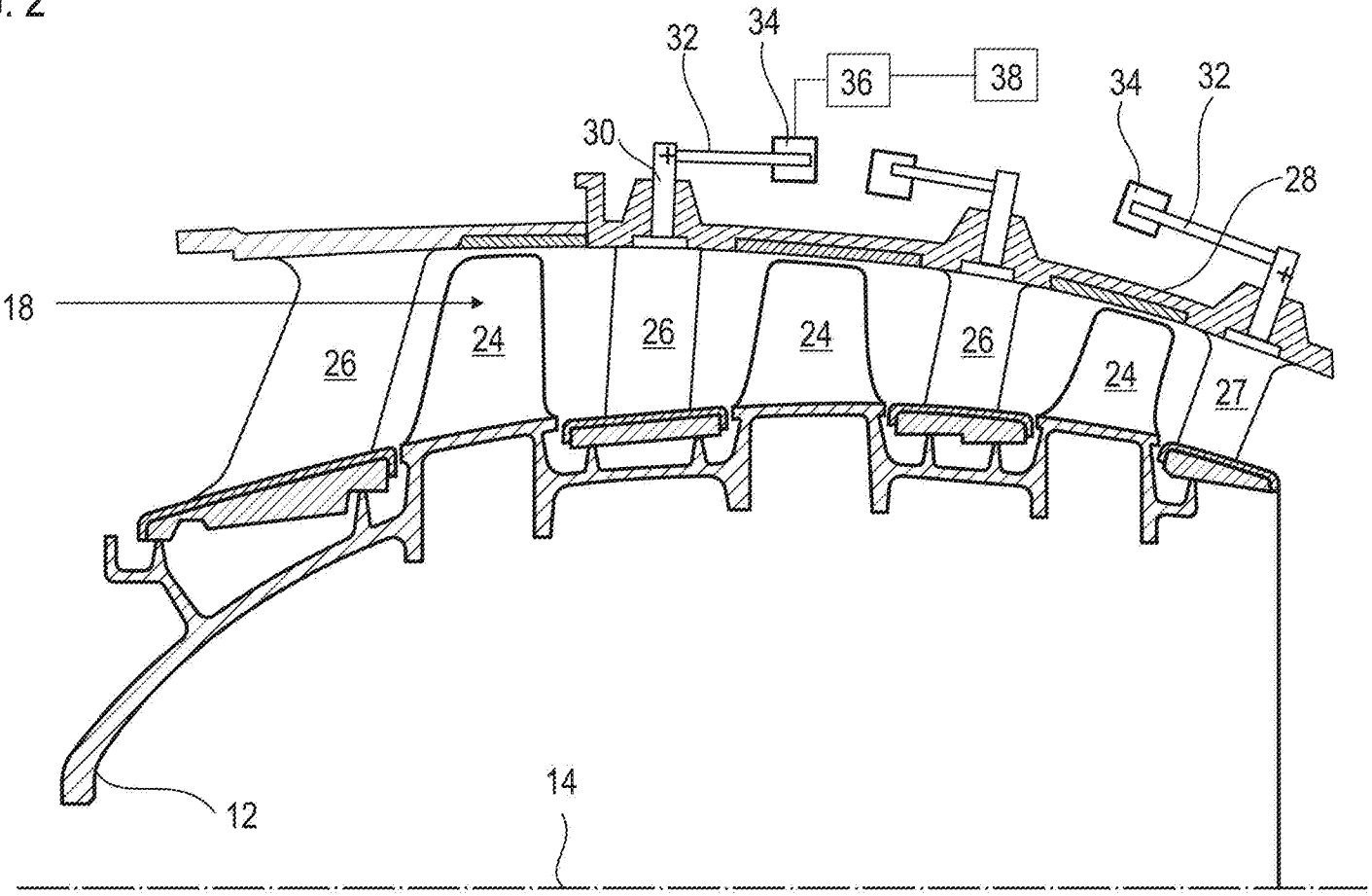
FIG. 2 is a diagram of a turbine engine compressor according to various embodiments of the the invention.

FIG. 2 is a sectional view of a compressor of an axial turbine engine such as that of FIG. 1. The compressor can be a low-pressure compressor 4, also called a booster. The rotor 12 comprises a plurality of rows of rotor vanes 24, numbering three in the present case. It can be a one-piece bladed drum, and/or can comprise vanes with dovetail attachments.

The low-pressure compressor 4 comprises a plurality of rectifiers, numbering four in the present case, each of which contains an annular row of stator vanes 26. Each rectifier is associated with the fan 16 or with a row of rotor vanes to rectify the air flow so as to convert the speed of the flow into pressure, notably into static pressure.

The stator vanes 26 extend essentially radially from an outer casing 28 forming a support and can be pivoted there by means of spindles 30 passing through openings formed in the casing 28. The combination of an opening and the spindle 30 that it receives forms a rotating mechanical link enabling the orientation of the vane 26 to be modulated. Such a vane is commonly referred to as a VSV for "Variable Stator Vane".

The vane body of the vane 26 can thus extend to a greater or lesser degree across the primary flow 18. The circumference of the primary stream occupied by the vane can be adjusted by adapting the orientation of the vane 26, that is to say by modifying the inclination of the mean chord of the vane 26 relative to the axis of rotation 14 of the turbine engine.

In order to transmit a coherent control movement to the adjustable vanes 26, actuating levers 32 are connected to a synchronizing ring 34 and to the spindles 30 at their other ends. The synchronizing rings 34 surround the axis of rotation 14, forming a belt around the outer casing 28. These rings 34 are controlled by actuators 36 connected to a control unit 38 which calculates the best orientation for the vanes on the basis of the operating conditions, including the rotation speed of the rotor 12.

The inner ends of the stator vanes 26 can be connected rotatably to inner shrouds adapted to allow the rotation of the stator vanes 26. The compressor can be mixed, because it can contain one or more rows of vanes having an adjustable orientation, and one or more rows of stator vanes having a fixed orientation 27, or single orientation, relative to the axis of rotation 14.

Figure 3:
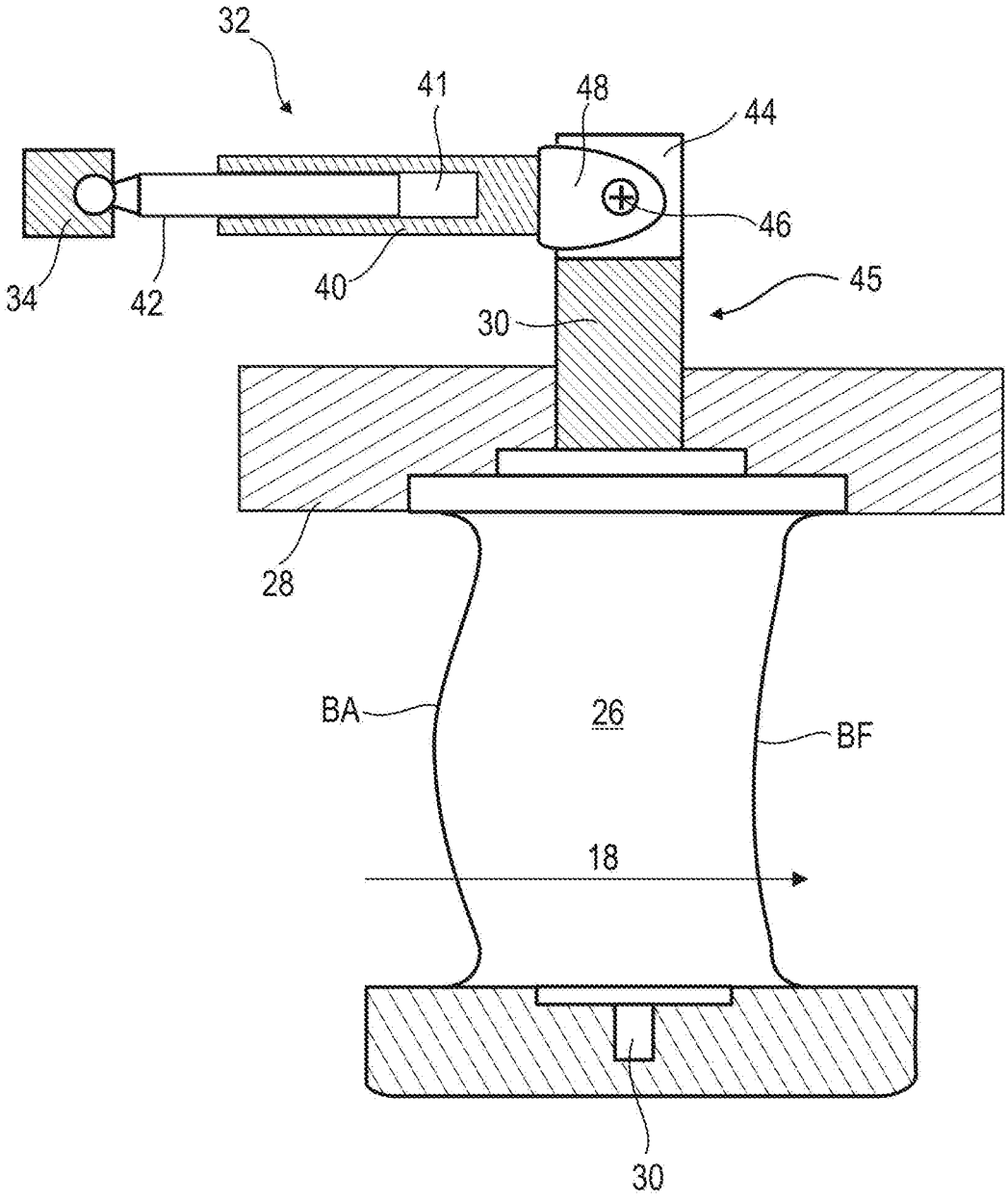
FIG. 3 shows a vane system with adjustable orientation according to various embodiments of the invention.

FIG. 3 is a sketch of a system of variable-orientation vanes 26. The system can be similar to that introduced with reference to FIG. 2. Here again there is a casing 28, an adjustable stator vane 26, a spindle 30, an actuating lever 32 and a synchronizing ring 34.

The adjustable vane 26 has a vane extending across the primary flow 18. The vane is radially extended by the spindles 30. The interfaces between the vane and the spindle can be formed by discs or buttons. This vane has a leading edge BA, a trailing edge BF, and a pressure surface and a suction surface which extend from the leading edge BA to the trailing edge BF. These surfaces can be concave and convex, respectively. They can form suitable aerodynamic profiles for deflecting the flow 18 while reducing flow separation. The ring 34 can be fastened axially relative to the casing 28, which simplifies the integration of its actuator.

Since the rotation of the adjustable vane 26 causes an elongation of the lever 32, the latter is made telescopic. The telescopic lever 32 can comprise a socket 40 with a cavity 41 receiving a slider 42. The slider 42 can form a rod sliding in and out of the socket 40. For example, the slider 42 is connected by a swivel joint to the ring 34, while the socket is attached to the spindle 30.

The spindle 30 has a slot 44, or notch, notably formed in a cylindrical portion 45 of the spindle 30. This slot 44 forms a central gap in the spindle 30. The spindle can form a fork. The slot 44 is integrated into the height and width of the spindle 30. It can pass through the spindle 30 along the diameter of the latter, from upstream to downstream for example. The slot 44 extends radially, that is to say along the spindle 30.

The diameter of the cylindrical portion 45, also called the cylindrical section, can be equal to that of the spindle portion 30 that passes through the casing 28. This configuration provides a maximum of material while allowing the spindle to be inserted from the inside of the casing 28. In this case, the strength is optimized while also meeting an assembly constraint.

A pivot joint 46 is used to connect the lever 32 to the spindle. This prevents bending stresses when the lever is actuated. The pivot joint 46 is positioned in the slot 44. In particular, it can be completely housed in the body of the spindle 30, and therefore in the body of the cylindrical portion 45.

The radial height of the slot 44 can be greater than the radial height of the lever 32. The inner base of the slot 44 and/or the inner face of the lever can be at a radial distance from the outer surface of the casing 28.

The lever 32 can comprise a portion of reduced thickness 48, attached to the spindle 30 by the pivot joint 46. This portion of reduced thickness 48 can be inserted into the slot 44. The portion 48 can form a linking lug, and/or a thinner area. A rod passing through the portion 48 and the spindle 30 can form the pivot joint 46.

Figure 4:
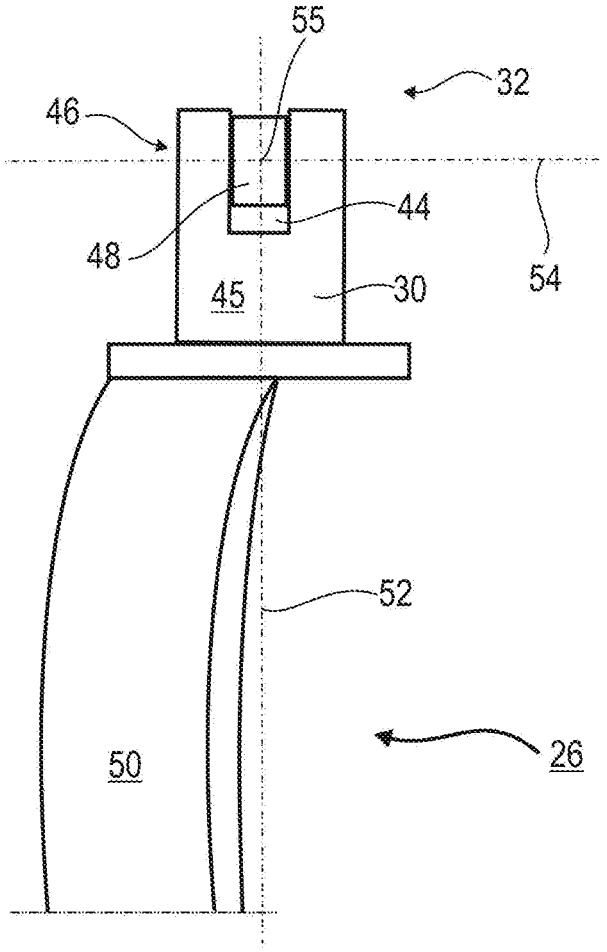
FIG. 4 shows an axial view of the vane system with adjustable orientation according to various embodiments of the invention.

FIG. 4 shows the adjustable orientation vane system as has been described with reference to FIGS. 2 and 3. The system is shown face-on, in the axial direction, and/or in a view directed along the sliding axis of the lever 32, which is partially masked by the spindle 30, although its portion of reduced thickness 48 is visible in the slot 44. Only a radial portion of the vane body 50 of the vane 26 is visible.

The thickness of the portion of reduced thickness 48 is less than or equal to the radius of the cylindrical portion 45 of the spindle 30, or less than half of the radius. This preserves the rigidity of the spindle 30 and increases the contact with the portion of reduced thickness 48 via which the actuating torque of the vane 26 is transmitted.

The spindle 30 has an axis of rotation 52 about which the vane 26 pivots. This axis 52 can cut the pivot axis 54 of the pivot joint 46. Since these axes (52; 54) touch at a point of intersection 55, they define a plane. They can also be orthogonal. This arrangement further improves the compactness while also reducing the actuating forces.

Figure 5:
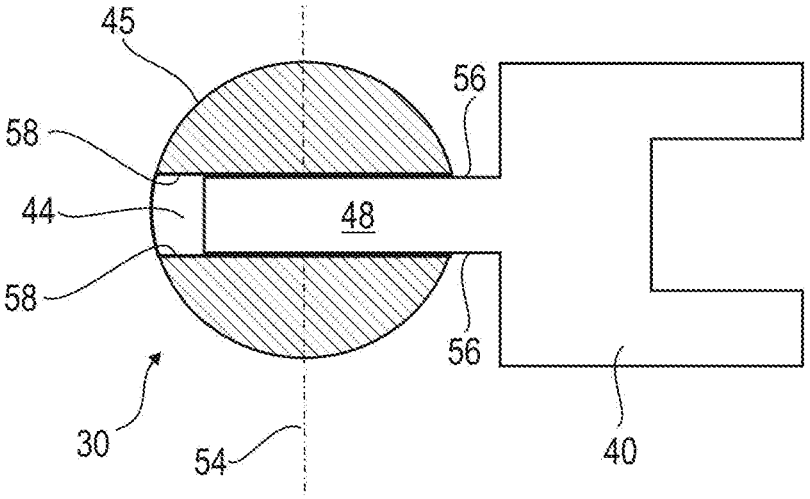
FIG. 5 is a top view of the vane system with adjustable orientation according to various embodiments of the invention.

FIG. 5 shows, is a top view of the adjustable orientation vane system as described with reference to FIGS. 2 and 4.

The socket 40 is at a distance from the spindle 30. These can be separated by a section of the portion of reduced thickness 48. The portion of reduced thickness 48 can have opposed surfaces 56. They can be perpendicular to the pivot axis 54. Facing these, the slot 44 can have inner surfaces 58. Each of the latter comes into contact with one of the opposed surfaces 56, allowing forces to be transmitted, thereby causing a change in the direction of the vane 26. The transmitted torque can increase. The torque transmission can be carried out simultaneously by means of the rod passing through the portion 48 and by the pairs of surfaces (56; 58) in contact.

The spindle 30 can have a constant diameter over most of its height, and/or in its portion lying outside the casing, and/or over the whole of its height. This height can be the height of the cylindrical portion 45.

Although only one vane with a spindle and one lever are shown, the present teachings can be applied to a whole annular row of vanes with spindles, each connected to an actuating lever. The vanes and levers of the row can be identical. Each row of vanes with spindles and levers, or a plurality of the rows, can be as described above.

What is claimed is:

1. A system for an axial compressor of a turbine engine, said system comprising:

a telescopic actuating lever having a portion of reduced thickness;

a variable stator vane with a vane body designed to extend radially in a flow of the turbine engine;

a spindle having a cylindrical portion comprising a radially extending slot, the slot extending along an entire diameter of the cylindrical portion so that the spindle forms a fork which when seen in an axial direction has a U shape, the slot receiving the portion of reduced thickness; and a rod passing through the portion of reduced thickness so as to form a pivot joint between the portion of reduced thickness and the spindle, the telescopic actuating lever being configured to communicate a rotary movement to the variable stator vane around its spindle.

2. The system according to claim 1, wherein the slot comprises inner surfaces in contact with the pivot joint of the lever.

3. The system according to claim 1, wherein the spindle comprises a radial end, the pivot joint being positioned radially between the vane body and the radial end.

4. The system according to claim 1, wherein the spindle has a constant diameter over its height.

5. The system according to claim 1, wherein the telescopic actuating lever comprises opposed lateral surfaces that are in contact with the slot.

* * * * *